US005522167A

United States Patent [19]

Teetzel

[11] Patent Number: 5,522,167

[45] Date of Patent: Jun. 4, 1996

[54] SWITCH APPARATUS

[76] Inventor: James W. Teetzel, 14 Stratham Green, Stratham, N.H. 03885

[21] Appl. No.: 349,369

[22] Filed: Dec. 5, 1994

Related U.S. Application Data

[63] Continuation-in-part of Ser. No. 303,860, Sep. 9, 1994, which is a continuation-in-part of Ser. No. 200,204, Jul. 23, 1994, Pat. No. 5,481,819, which is a continuation-in-part of Ser. No. 89,889, Jul. 12, 1993, Pat. No. 5,425,299, which is a continuation-in-part of Ser. No. 73,766, Jun. 8, 1993, Pat. No. 5,355,608.

[51] Int. Cl.[6] ..... F41G 1/36

[52] U.S. Cl. ..... 42/103; 362/113; 362/114; 250/208.4

[58] Field of Search ..... 42/103; 362/110, 362/113, 114; 250/491.1, 561, 208.4; 340/942

[56] References Cited

U.S. PATENT DOCUMENTS

| | | | |
|---|---|---|---|
| 3,304,241 | 2/1967 | Radcliffe et al. | 250/491.1 |
| 3,660,036 | 5/1972 | Benson | 250/302 |
| 3,805,061 | 4/1974 | De Missimy et al. | 250/209 |
| 3,912,924 | 10/1975 | Barrett, Jr. | 250/208.4 |
| 4,665,378 | 5/1987 | Heckethorn | 340/51 |
| 4,808,997 | 2/1989 | Barkley et al. | 340/942 |
| 5,374,830 | 12/1994 | Pryor | 250/561 |

*Primary Examiner*—Stephen M. Johnson
*Attorney, Agent, or Firm*—William B. Ritchie

[57] ABSTRACT

A tritium switch that can be easily fitted to standard laser sight that can be easily adapted to fit standard semi-automatic handguns or to standard military rifles such as an M-16. The switch is also useful as a safety interlock switch on machinery requiring electrical power. With a firearm, the switch allows the user to engage and disengage the laser sight without the necessity of reaching a special button or part of the weapon. The switch can be fitted to a standard trigger of the weapon so that the switch can be thrown as the user readies the weapon for firing. The switch is fabricated from using commercially available parts. The emitter portion of the switch, that is, the tritium vile requires no power and the detector portion, a low power consuming photoelectric cell, can be powered by commercially available batteries, providing a long service life before needing to be changed.

8 Claims, 4 Drawing Sheets

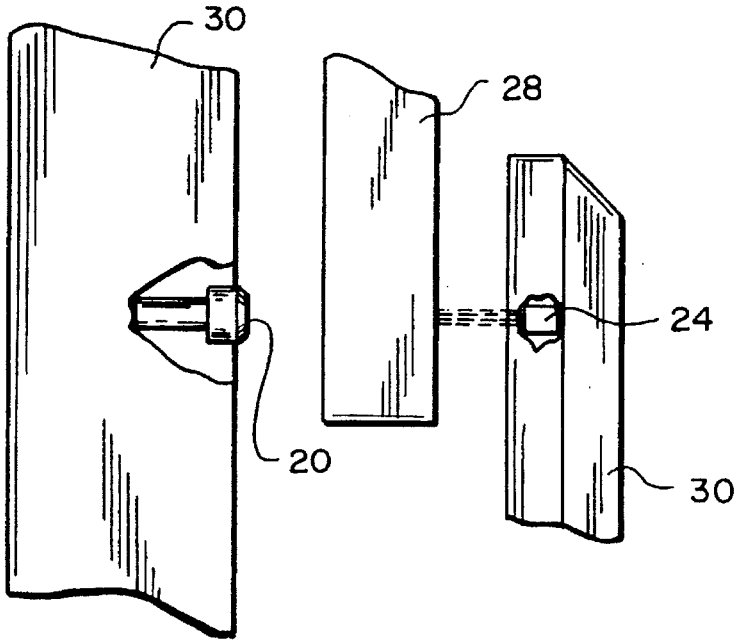
FIG. 3
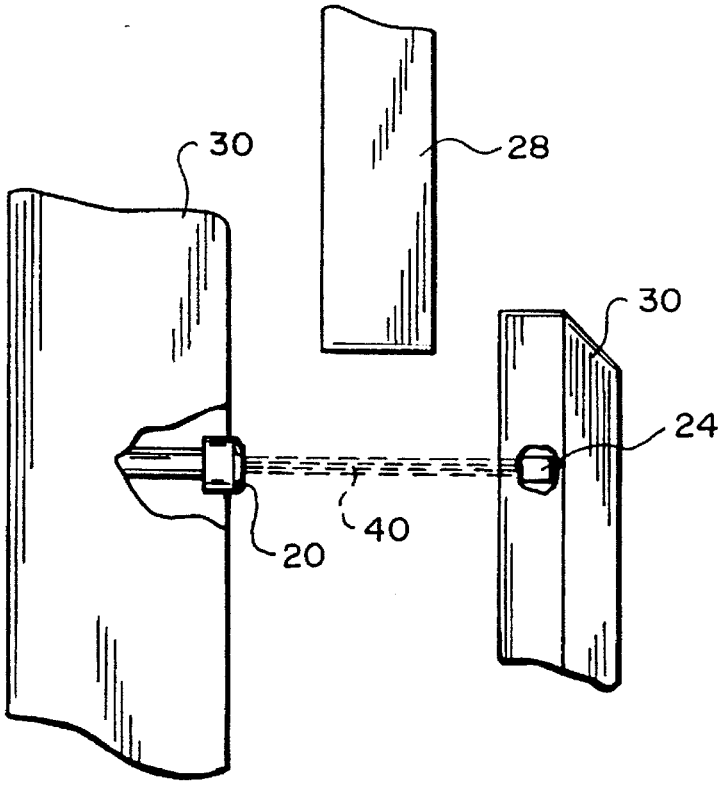

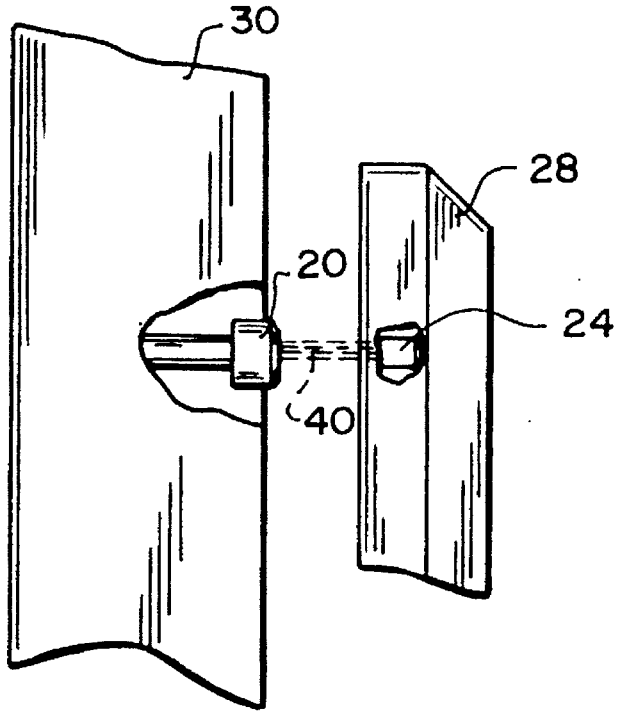
FIG. 4
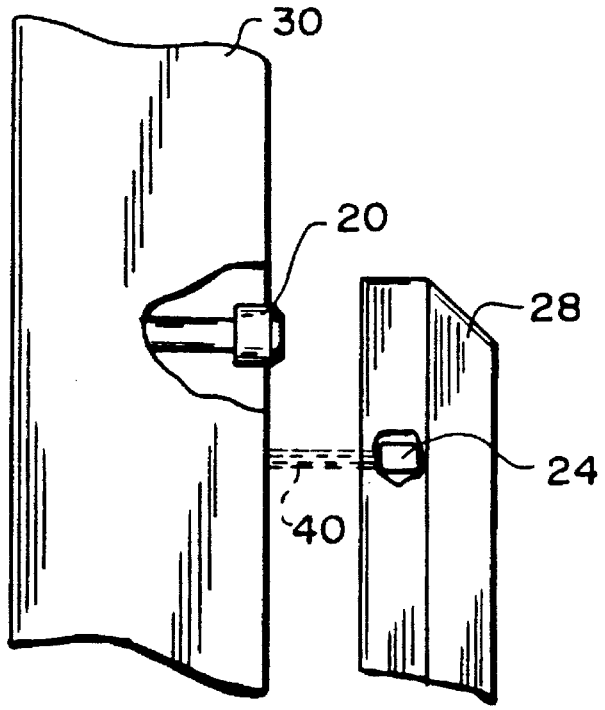

SWITCH APPARATUS

This application is a continuation-in-part of U.S. patent application Ser. No. 08/303,860, filed Sep. 9, 1994, still pending which is a continuation-in-part of U.S. patent application Ser. No. 08/200,204, filed Jul. 23, 1994, now U.S. Pat. No. 5,481,819, which is a continuation-in-part of U.S. patent application Ser. No. 08/089,889, filed Jul. 12, 1993, now U.S. Pat. No. 5,425,299, which is a continuation-in-part of U.S. patent application Ser. No. 08/073,766, filed Jun. 8, 1993, now issued as U.S. Pat. No. 5,355,608.

BACKGROUND OF THE INVENTION

1. Field of the Invention

The invention relates to a tritium trip switch for laser sights for use on small firearms, particularly semi-automatic handguns and rifles. The switch is also useful for safety interlock applications on machinery.

2. Description of the Related Art

The addition of a laser sighting device for small arms permits firing these weapons using an "instinctive aiming" approach. That is, the weapon is fired not using sights, but rather A solution to this problem for handguns has been the introduction of laser sights. The typical laser sight is mounted on the weapon, usually on top of firearm, however, bottom mounted sights can also be used. The laser sight when properly aligned, places a red light dot on the target where the bullet will strike if the gun is fired. Using this type of sight, enables the law enforcement officer or soldier to rapidly instinctively properly position the weapon and be certain of his/her intended target. Using a laser sight enables accurate shots to be fired at distances of more than 50 feet, sufficient for most combat law enforcement situations requiring the use of handguns.

While these devices offer exceptional advantages with weapons so equipped, laser sights are typically an add-on feature. Further, most such units must be activated by a switch on the unit itself. However, this is awkward and can result in a dangerous delay between the time that the weapon is readied and the laser sight is activated for firing.

A reliable, low cost, switch that can be easily retrofitted to virtually all small arms which can be used to activate electronic devices such as laser sights is not found in the prior art.

Prior art laser devices have several disadvantages. Whether the switches are mounted either on the right or left side of the weapon, the user must find the switch for the laser before he/she is able to begin to move the gun into alignment for hitting the desired target. A laser sight capable of being installed in a semi-automatic handgun, easily and accurately adjustable, and capable of being activated by placing a finger on the trigger of the weapon is not disclosed in the prior art.

SUMMARY OF THE INVENTION

It is an object of the invention to provide a tritium switch apparatus that can activate a laser sight thus allowing the user to engage and disengage the laser sight without the necessity of reaching a special button or part of the handgun.

It is an object of the invention to provide a tritium switch apparatus that can be easily adapted to fit standard semi-automatic handguns or to standard military rifles such as an M-16.

It is another object of the invention to provide a tritium switch apparatus that can be fitted to a standard trigger of the weapon so that the switch can be thrown as the user readies the weapon for firing.

It is still another object of the invention to provide a tritium switch apparatus that can be fitted to various semi-automatic handguns and military rifles requiring a minimum replacement of standard parts.

It is another object of the invention to provide a tritium switch apparatus that can be inexpensively produced using primarily commercially available parts.

It is another object of the invention to provide a tritium switch apparatus that requires no power for the tritium vile and a low power consuming photoelectric cell so that the switch can be powered by commercially available batteries, providing a long service life before needing to be changed.

It is another object of the invention to provide a tritium switching apparatus that eliminates the need for a pressure pad on the grip handle which is awkward when holding the gun and requires adjustments to the shooter's grip to keep the laser off while maintaining stability.

The invention is a switch apparatus for a device requiring electrical power such as a small arms laser sight. A tritium vile is rigidly fixed in position in a convenient location on the firearm such as a trigger or trigger housing. The tritium vile is capable of emitting a detectable and identifiable electromagnetic signal. Electromagnetic detection means is provided and is aligned with said tritium vile. Electromagnetic detection means is capable of detecting the signal provided by said tritium vile. The electromagnetic detection means is fixed in position in a convenient location on the firearm, such as the front portion of the trigger housing if the trigger housing or trigger is used to mount the tritium vile. The mounting is position so that there is a predetermined distance between said electromagnetic detection means and said tritium vile with sufficient space to permit a predetermined object to pass between said tritium vile and said electromagnetic detection means. The most convenient object to pass between said tritium vile and said electromagnetic detection means is the trigger finger of the user. When the trigger finger of the user interrupts said signal from said tritium vile to said electromagnetic emission means, the device, typically, a laser sight is activated.

BRIEF DESCRIPTION OF THE DRAWINGS

FIG. 3 is a side view of the tritium switch apparatus mounted on a typical machine to serve as a safety interlock switch.

FIG. 4 is a side view of the tritium switch apparatus mounted on a typical machine using an alternative mounting arrangement.

DETAILED DESCRIPTION OF THE INVENTION

Figure 1:
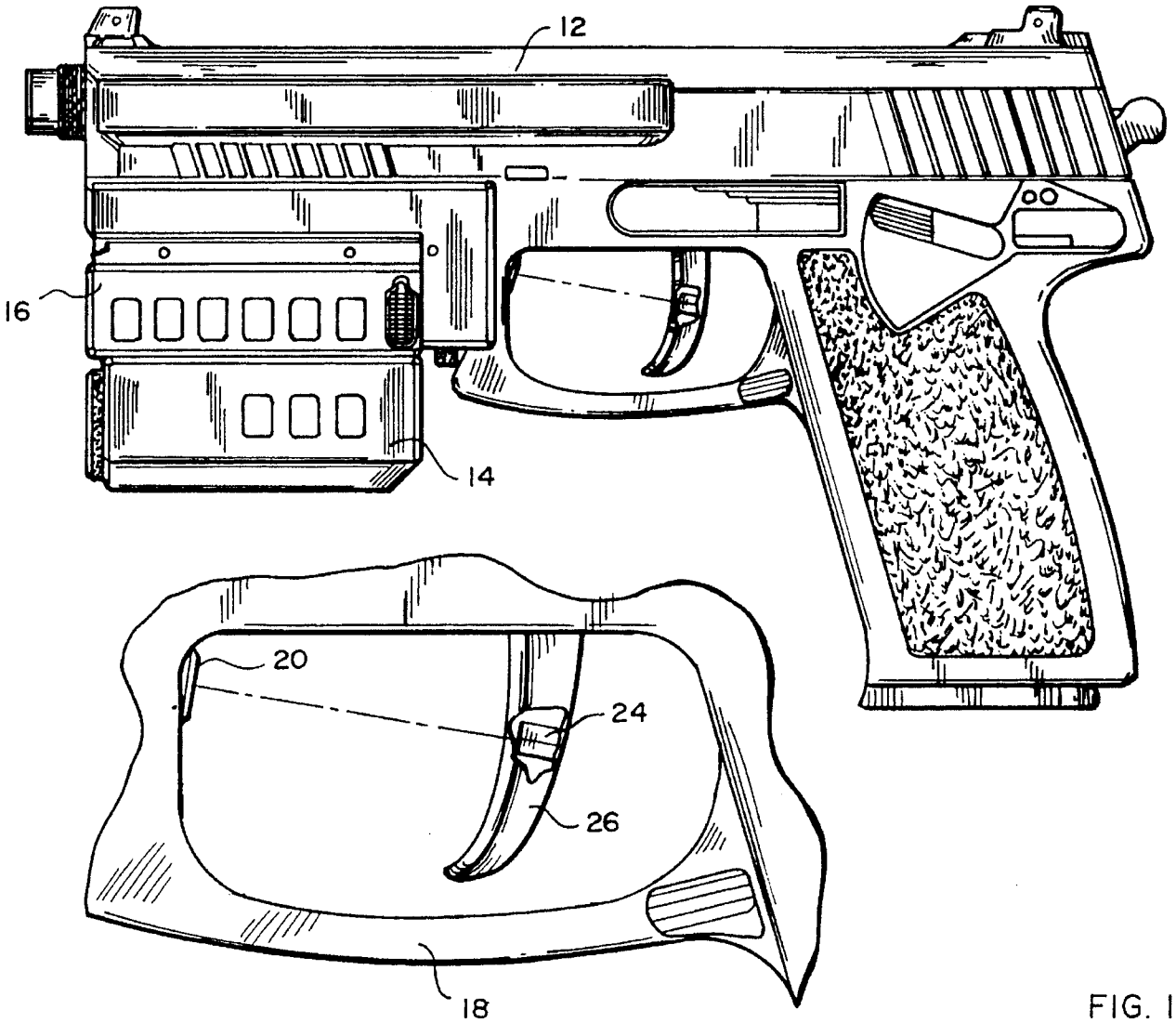
FIG. 1 is a side view of the tritium switch apparatus mounted on a typical offensive handgun.

The invention is a tritium switch apparatus that is easily adaptable to the offensive handgun, as well as M4A1, M16, SMAW-D and other small arms. As shown in FIG. 1, the invention is mounted on a typical offensive handgun 12. Mounting on other weapons would be accomplished in a similar manner. Handgun 12 is fitted with laser sight module 16 and flashlight module 14. Isotope vile 24 is mounted in trigger 26. Isotope vile 24 is preferably a tritium vile of the type sold by TRIJICON, INC. of Farmington Hills, Mich. However, a vile containing a different isotope could also be used. Since vile 24 requires no power because of its radioactive nature, it permits it to be installed in otherwise inaccessible locations. Photoelectric cell 20 is mounted in trigger housing 18 so that it is aligned with the emission from vile 24. Cell 20 is selected to that it is responsive to the specific emission of vile 24. Once the user picks up the weapon and places his/her finger on the trigger, the beam from vile 24 to cell 20 is interrupted and laser sight module 16 is correspondingly activated. As tritium has a half life of approximately 12 years, the vile 24 will provide a usable beam signal for many years without the need for replacement. The invention could also be similarly installed on a rifle or any weapon having a trigger guard and trigger.

Figure 2:
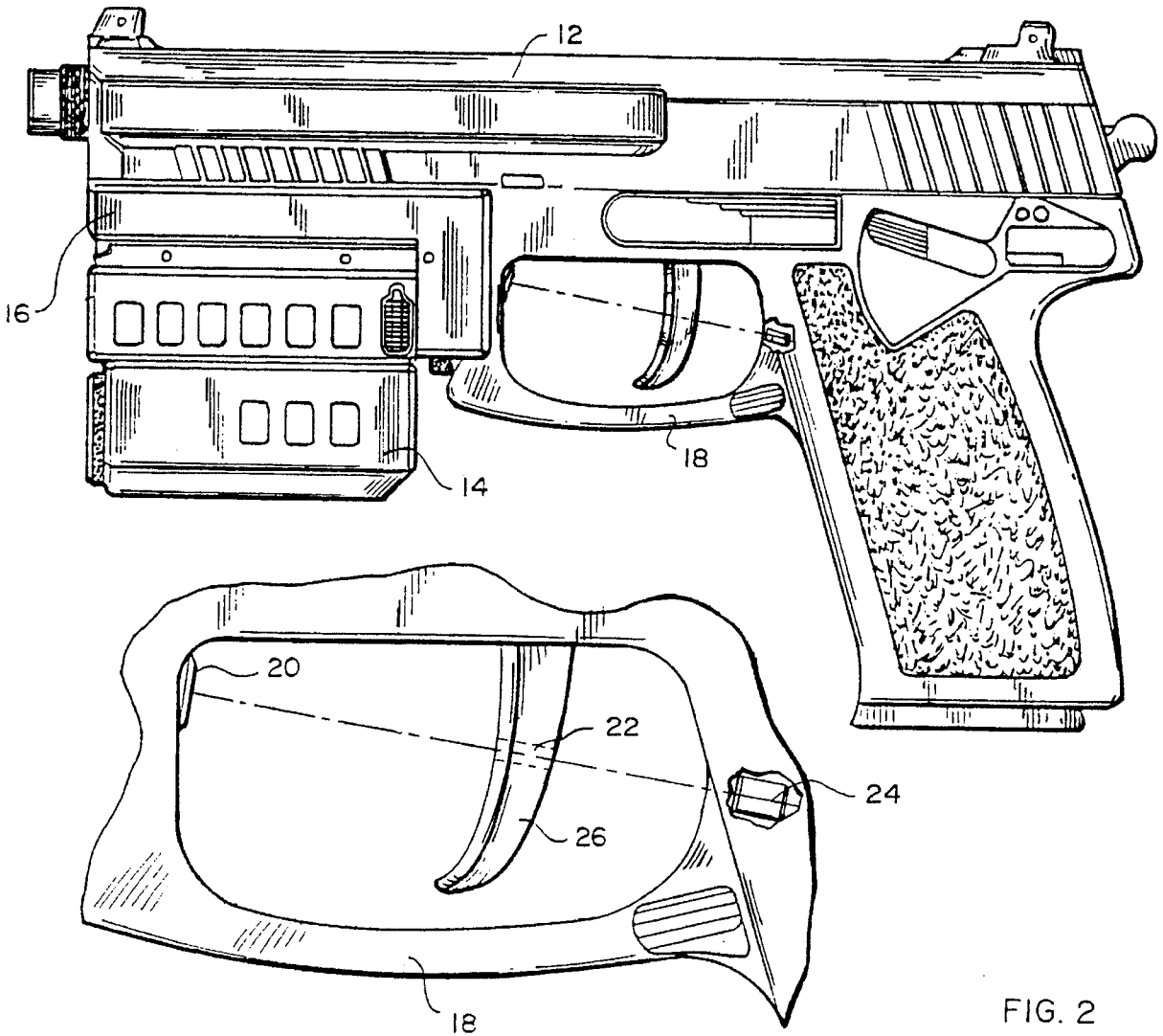
FIG. 2 is a side view of the tritium switch apparatus mounted on a typical offensive handgun using an alternative mounting arrangement.

FIG. 2 shows an alternative mounting arrangement. In this embodiment, vile 24 is mounted the rear portion of trigger housing 18. Again, cell 20 is mounted on the front portion of trigger housing 18. Cell 20 and vile 24 could be aligned to either to the left or to the right of trigger 26 so that the beam signal from vile 24 would reach cell 20 unless a user placed his/her finger on trigger 26. Optionally, cell 20 and vile 24 could be aligned through trigger 26 via opening 22. Since only a small beam is required to complete the circuit, opening 22 could have a very small diameter, thereby not interfering with accurately firing the weapon or with the strength of trigger 26.

Since the installed switch is extremely small, it can be mounted in places where standard switches would not fit. In FIG. 3, the invention is shown attached to machine 30 to serve as a safety interlock switch. Vile 24 is attached near the region where safety device 28, such as hand guard, eye shield, etc. is supposed to be in place when machine 30 is operating. Cell 20 is then attached also near vile 24 but positioned so that the beam signal from vile 24 cannot reach cell 20 when safety device 28 is correctly in position. If safety device 28 is removed, cell 20 will detect beam signal 40 from vile 24 and power to machine 30 is shut off.

In FIG. 4, the invention again functions as a safety interlock switch which prevents power to machine 30 is safety device 28 is not in place. In this arrangement, vile 24 is attached directly to safety device 28. Since vile 24 requires no external power, it is possible to use the invention when other switches could not be used. As before, cell 20 is attached to machine 30 in the region where safety device 28 is to be placed when machine 30 is operating. If safety device 28 is removed, beam signal 40 from vile 24 is interrupted. Machine 30 will then be shut off when the beam signal is not detected by cell 20.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A switch apparatus for a laser sight requiring electrical power and attached to a firearm having a trigger and a trigger housing, with said trigger housing having a front portion and rear portion, said switch apparatus comprising:

isotope means for emitting a detectable and identifiable electromagnetic signal;

electromagnetic detection means for detecting the signal provided by said isotope means when said detection means is within a predetermined alignment position relative to said isotope means; and wherein, the detection of said signal by said electromagnetic detection means determines whether electrical power is provided to said laser sight; and wherein said signal from said isotope means is prevented from reaching said detection means by a predetermined object, located between said isotope means and said electromagnetic detection means.

2. The switch apparatus of claim 1 wherein such that when said signal is prevented from reaching said detection means by the predetermined object, electrical power is provided to said device.

3. The switch apparatus of claim 1 wherein the predetermined object is removed from between said isotope means and said electromagnetic detections means, electrical power is shut off to said device.

4. The switch apparatus of claim 1 wherein said electromagnetic detection means is a photoelectric cell.

5. The switch apparatus of claim 1 wherein said isotope means is a tritium vile.

6. The switch apparatus of claim 1 wherein said electromagnetic detection means is attached to the front portion of the trigger housing of the firearm, said isotope means is attached to the trigger of the firearm, and the object that is inserted between said electromagnetic detection means to interrupt said signal is a user's trigger finger.

7. The switch apparatus of claim 1 wherein the firearm is an offensive handgun.

8. The switch apparatus of claim 1 wherein the firearm is an military rifle.

* * * * *